United States Patent [19]

Fischer, Jr.

[11] Patent Number: 4,487,346

[45] Date of Patent: Dec. 11, 1984

[54] INFANT SLING-TYPE CARRIER

[76] Inventor: Benhardt B. Fischer, Jr., 2085 Albion St., Denver, Colo. 80207

[21] Appl. No.: 501,424

[22] Filed: Jun. 6, 1983

[51] Int. Cl.[3] ..... A45F 3/04; A45F 3/12; A47D 13/02

[52] U.S. Cl. ..... 224/160; 224/258; 224/259

[58] Field of Search ..... 224/158, 159, 160, 161, 224/264, 202–209, 257, 258, 259

[56] References Cited

U.S. PATENT DOCUMENTS

| | | | |
|---|---|---|---|
| 393,555 | 11/1888 | Griffin | 224/158 |
| 522,018 | 6/1894 | Kehlenbeck | 224/159 |
| 1,039,009 | 9/1912 | Averill | 224/159 |
| 1,162,662 | 11/1915 | Sprong | 224/160 |
| 1,196,003 | 8/1916 | Lippincott | 224/159 |
| 1,302,312 | 4/1919 | Cook | 224/205 |
| 2,411,721 | 11/1946 | Hancock et al. | 224/159 |
| 2,468,588 | 4/1949 | Clemens, Jr. | |
| 2,535,683 | 12/1950 | Kimball | |
| 2,690,864 | 10/1954 | Dautermann et al. | |
| 3,332,593 | 7/1967 | Fauser | |
| 3,366,294 | 1/1968 | Stephenson | |
| 3,435,867 | 4/1969 | Hyden | 224/264 X |
| 3,587,952 | 6/1971 | Higuchi | 224/160 |
| 3,841,543 | 10/1974 | Bolton | 224/158 |
| 4,149,687 | 4/1979 | Nunemacher | 224/159 |

FOREIGN PATENT DOCUMENTS

| | | | |
|---|---|---|---|
| 123094 | 1/1947 | Australia | 224/161 |
| 106331 | 6/1923 | Switzerland | 224/160 |

*Primary Examiner*—Allan N. Shoap
*Attorney, Agent, or Firm*—John E. Reilly

[57] ABSTRACT

A sling-type infant carrier has an endless strap which extends in diagonal fashion from one shoulder of the wearer downwardly along the front and back of the torso so as to loop around the opposite side of the wearer at or near the hip or waist region. The lower looped end of the strap has a child-support portion in the form of a pad of flexible, elongated tubular construction surrounding and secured to the lower looped end which can be straddled by the child. A side-reinforcing portion has opposite ends attached to the endless strap about or slightly beyond the child support region and preferably is releasably and adjustably attached to the endless strap at least at one end so as to permit adjustable attachment to conform to the size of the child and comfortably pass around the outside of the child along the waist or chest region somewhat beneath the arm. An auxiliary shoulder strap may be used which extends over the other shoulder of the wearer with opposite ends secured to the front and back portions of the endless strap.

13 Claims, 3 Drawing Figures

INFANT SLING-TYPE CARRIER

This invention relates to new and useful improvements in infant carriers; and more particularly relates to a novel and improved sling-type carrier to be worn by a parent or other adult person for the purpose of carrying infant children in a secure and comfortable position.

BACKGROUND AND FIELD OF THE INVENTION

Numerous approaches have been taken to the design and construction of infant carriers essentially of the type which can be placed over a shoulder or both shoulders of the adult and are provided with some form of a pouch or seat into which the baby is placed so as to be held closely against either the front or back of the adult. However, it is desirable to provide an infant carrier of the type which will securely hold the baby in place on the carrier with a minimum of confinement and further in such a way as to be most comfortable for the adult and the baby when held over extended time periods. In the past, while carriers which may be generally characterized as sling-type carriers which will pass over the shoulder or shoulders of the wearer have been devised, all generally provide for some means for seating the child either in a direction facing toward or directly away from the wearer. Representative of such approaches are those as illustrated and disclosed in U.S. Pat. Nos. 2,468,588 to C. W. Clemens, Jr.; 2,535,683 to W. S. Kimball; 2,690,864 to E. W. Dautermann et al; 3,332,593 to E. E. Fauser; and 3,366,294 to K. C. Stephenson. Thus while patents, such as, Kimball and Dautermann et al hereinabove referred to may generally be said to disclose the use of a sling or loop-type strap which passes over the shoulder of the wearer an accessory portion, such as, a pouch, seat or leg support is provided other than the strap itself with which to secure and retain the child in position.

SUMMARY OF THE INVENTION

Accordingly an object of the present invention is to provide for a novel and improved infant carrier which is of simplified, lightweight construction but will securely and safely support a child in a comfortable position with respect to the adult person carrying the child.

It is another object of the present invention to provide for an infant carrier of the sling type in which the sling itself serves as the primary child-supporting portion and in such a way that the child can be safely carried astride the sling itself while affording maximum freedom of movement both for the child and adult.

It is a further object of the present invention to provide for a novel and improved infant carrier which is conformable for use by wearers and infants of different sizes with a minimum of adjustment required; and further wherein the infant child or baby can be supported more in a position along the side of the hip or waist region of the wearer.

A still further object of the present invention is to provide for a novel and improved infant carrier of the sling type which is characterized by ease of placement and/or removal by the adult as well as placement or removal of the child on the carrier; and further wherein the infant child is comfortably and securely supported in such a way that the carrier does not completely encircle either the adult or the infant child.

In accordance with the present invention, an infant carrier has been devised in which an endless strap is arranged for extension in diagonal fashion from one shoulder of the wearer downwardly across the front and back of the wearer's torso to terminate in a lower looped end surrounding the opposite side at or near the hip or waist region of the wearer. A child support portion in the form of a pad or cushion covers the lower looped end of the strap with the padding portion in upwardly facing relation away from the lower looped end which is straddled by the child. Lateral support means extends between intermediate portions of the strap to partially encircle one side of the infant away from the wearer when the infant is placed astride the lower looped end of the strap.

In the preferred form of invention, the strap is preferably in the form of a belt which is adjustable in length and the lower child support portion is in the form of a flexible elongated padding disposed in closely-surrounding relation to the lower looped end of the strap. The lateral support means takes the form of a side reinforcing strap releasably interconnected at opposite ends to intermediate portions of the diagonal strap so as to permit adjustable attachment to conform to the size of the child and comfortably pass around the outside of the child along the waist or chest region somewhat beneath the arm. An auxiliary or secondary shoulder strap may be used for extension over the other shoulder of the wearer with opposite ends secured to the front and back portion of the endless strap so as to more evenly distribute the weight of the child.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
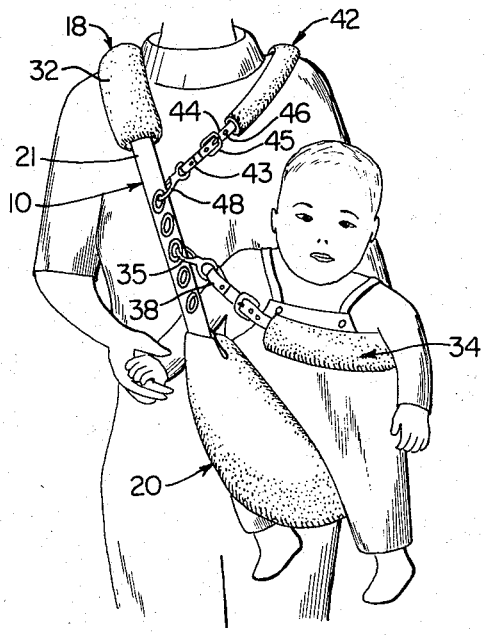
FIG. 1 is a somewhat perspective view illustrating the positioning of a preferred form of infant carrier on the body of the wearer and the manner in which a child is supported thereon.
Figure 2:
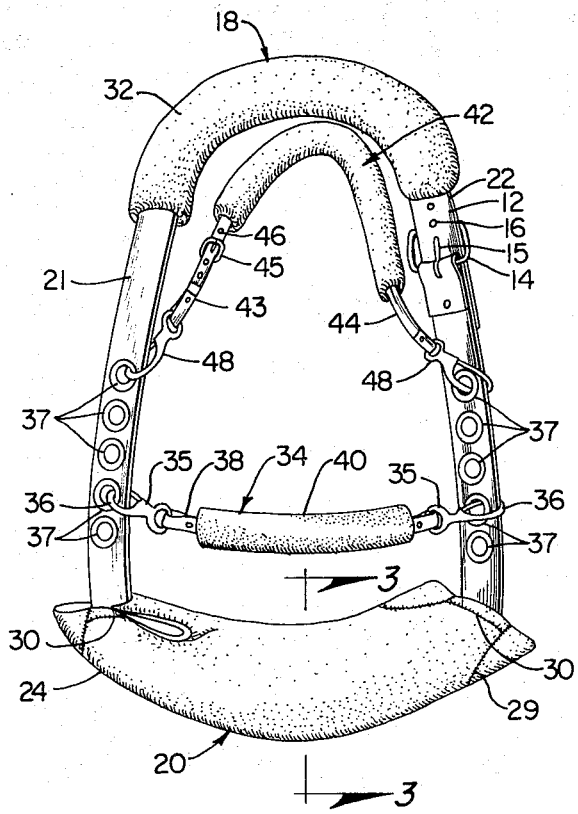
FIG. 2 is an enlarged perspective view of the preferred form of infant carrier shown in FIG. 1 and illustrating the attachment of a secondary shoulder strap thereon.
Figure 3:
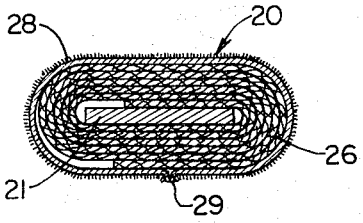
FIG. 3 is a cross-sectional view taken about lines 3—3 of FIG. 2.

Referring in detail to the drawings, there is illustrated in FIGS. 1 to 3 a preferred form of infant carrier in the form of a sling 10 having an elongated strap or belt 12. The strap 12 is of unitary or one-piece construction and comprised of a thin, flat and elongated length of leather, Nylon, fabric or suitable webbing material. One end of the strap has a fastener 14 which may be a conventional belt buckle or clasp with a tongue 15. A series of longitudinally spaced apertures 16 are disposed along an opposite free end of the strap so as to permit the buckle 14 to be adjustably secured to that end and thereby establish the desired effective length of the strap. In this relation, the strap 12 is of a length to enable it to be formed into an endless loop which extends diagonally from an upper shoulder-supporting portion 18 to a lower terminal loop end 20 across the side of the waist or hip region of the wearer opposite to the shoulder.

When supported in this position, the strap has front and back intermediate portions 21 and 22, respectively, which extend diagonally between the upper portion 18 and looped end 20 with the fastener portions 14 and 16 connected together along the back portion 22 of the belt.

The lower looped end portion 20 is covered by a generally tubular cushion or padding 24 which serves in combination with the lower end of the strap 12 as the child-supporting portion, the padding 24 being disposed in close-fitting, surrounding relation to the lower end. Most desirably, the pad is in the form of an elongated, flexible generally tubular member which, as shown in FIG. 3, has an inner spirally wound layer or series of layers 26 composed of a suitable fabric filler material or synthetic batting and which layers are in turn fully enclosed within an outer covering or tube 28, the latter preferably composed of lambskin and which is applied around the fabric filler layers 26 and secured together by a seam 29. Preferably, the outer tube 28 is gathered or folded at opposite ends and sewn along the seams designated at 30 to tightly embrace the strap 12 and resist any tendency of the covering to shift or rotate. Further, when the baby is placed on the tube it will tend to flatten it as shown in FIG. 3 and resist any tendency of the tube 28 to rotate. The padding 24 is preferably of a length to cover that section of the strap 12 which passes along or across the side of the waist or hip region so that the infant can be comfortably positioned on the padding so as to straddle or sit astride the padding portion as illustrated in FIG. 1. When in desired relation to the lower looped end of the belt and secured thereto, the padding 24 will remain in place and not tend to creep, slide or rotate especially under the pressure of the child when straddling the pad. In the alternative, the padding 24 may be removably secured to the lower end and merely gathered or folded at the ends without attaching to the strap by means of the seams 30. In this way, the gathered or folded ends of the padding will snugly engage the strap; yet the padding is slidable under positive pressure to enable its removal from the strap for cleaning or replacement if desired.

The upper shoulder support portion or end 18 similarly is provided with an outer padding or covering 32 which is of elongated flexible tubular construction and may be formed in a manner corresponding to that of the padding 24 for the child support portion but with a reduction in the number of inner layers 26; or, in the alternative, may simply consist of an outer covering which corresponds to the covering 28. Preferably, the shoulder support covering 32 is adjustably positioned with respect to the strap so that it can be shifted in relation to the child and permit positioning of the child in the most comfortable position. In this manner, for example, the covering 32 can be adjusted so that the lower child support portion and padding 24 can be shifted to a position so that the padding 24 will serve as somewhat of a backrest to support the baby in a semi-reclining position.

In order to retain the infant in a substantially upright position on the child support portion, a flexible supporting strap 34 is attached by releasable fasteners 36 for lateral insertion between opposite ends 35 of the strap 34 and the front and back portions 21, 22 of the strap 12. The releasable fasteners 36 are illustrated as being in the form of conventional swivel hooks extending from each end 35, each hook adapted to be inserted through one of a series of grommets 37 along the front and back portions 21 and 22, the grommets 37 starting at a point directly above the ends of the padding 28 and continuing at longitudinally spaced intervals as illustrated. The supporting strap 34 is comprised of a thin, elongated strap or belt portion 38 of a width slightly less than that of the strap 12 and having an outer padding 40 which corresponds to that of the shoulder support portion and lower child support portion; thus, it has a cross-section substantially the same as that illustrated in FIG. 3 but of greatly reduced thickness. The side supporting strap 34 is dimensioned to be of a length which will permit it to sag somewhat when attached across the front and back portions of the sling and afford some freedom of movement for the child when in position on the child-support portion, as illustrated in FIG. 1. Of course, the degree of tautness and the position of the strap 34 can be regulated by the grommets selected for attachment of the strap 34. The strap 34 includes a buckle portion, not shown, but which corresponds to the fastener 14 employed on the main strap or belt 12 to permit some addition of degree of regulation of the tautness and effective length thereof. The padding 40 is free to slide with respect to the strap 34 so that it can be adjusted with respect to the child and afford the proper lateral support for the child in various positions straddling the lower looped end of the main strap 12.

An additional feature of the present invention resides in the use of a second shoulder strap portion designated at 42 which is constructed in a manner corresponding to the side strap 34 but is of a greater length and is provided with two separate belt sections; namely, a shorter section 43 and a longer section 44 so as to permit some length adjustment via the use of a belt buckle 45 which is adjustably secured in one of a series of apertures 46 along the length of the shorter section 43. Swivel hooks 48 at each end are releasably attached to grommets 37 as shown. It has been found that the use of a secondary shoulder strap, which forms somewhat of a vee with the shoulder support portion 18, will more uniformly distribute the weight of the child especially as the baby's size increases. Whether or not the secondary shoulder strap is employed, it will be appreciated that the carrier can be easily placed over the head of the wearer with the lower looped end extending downwardly across either side of the wearer. Moreover, the child can be readily shifted from one side to the other merely by transferring the shoulder support portion around the neck to the other shoulder. In either position, the child is placed astride the lower looped end so as to rest on the padding 24 and easily face either in a direction toward or away from the wearer. In this position, the child is in its most natural position for feeding and attention with a minimum degree of confinement. Moreover, the child will more or less rest against the side and upper arm portion of the wearer so that if desired the arm can be passed around the outside of the child as an added degree of security both for the child and wearer. It is emphasized, however, that the lateral support portion 34 is sufficient in and of itself to securely support the child and to comfortably hold it against the body and/or arms of the wearer.

It is therefore to be understood that various modifications and changes in the construction and arrangement of parts comprising the preferred embodiment of the present invention may be made without departing from the spirit and scope thereof as defined by the appended claims.

I claim:

1. An infant carrier comprising an endless strap extending diagonally from one shoulder of the wearer downwardly across the front and back of the wearer's torso and terminating in a lower looped end surrounding the opposite side at or near the waist region of the wearer, and straddle means extending lengthwise along said lower looped end of said strap upon which an infant child is straddled in a forwardly facing position, comprising a padding portion disposed in at least upwardly facing relation away from said lower looped end of said strap, said padding portion having a central portion which is relatively widened with respect to said lower looped end and opposite ends attached in fixed relation to said lower looped end.

2. An infant carrier according to claim 1, including side support means in the form of a laterally extending member extending between intermediate portions of said strap, said support means passing around one side of the child.

3. An infant carrier according to claim 2, said side support means being in the form of a strap having opposite ends releasably secured to intermediate portions of said endless strap, and a movable padding member of elongated generally tubular configuration in closely surrounding relation to said side support strap.

4. An infant carrier according to claim 1, including means for adjusting the length of said sling.

5. An infant carrier according to claim 1, including a second shoulder strap portion having opposite ends releasably secured to front and back intermediate portions of said endless strap for extension over the other shoulder of the wearer.

6. An infant carrier according to claim 1, said padding portion being of elongated generally tubular configuration.

7. An infant carrier according to claim 6, said padding portion composed of a flexible material and being several times the thickness of said strap.

8. An infant carrier according to claim 1, including a movable shoulder support pad of elongated generally tubular configuration in closely surrounding relation to the shoulder portion of said strap.

9. An infant carrier comprising an endless strap arranged to extend diagonally from one shoulder of the wearer downwardly across the front and back of the wearer's torso and terminating in a lower looped end surrounding the opposite side adjacent to the hip or waist region of the wearer, means for adjusting the length of said strap, and a child support member of flexible elongated tubular construction disposed in outer surrounding relation to said strap upon which an infant child is straddled having a padding means extending lengthwise of the strap and immovably secured along the lower looped end of said strap with a padding portion at least in upwardly facing relation away from the lower looped end of the strap, said padding portion including opposite ends tapering away from a relatively widened central portion for connection to said lower looped end; and a side support strap extending between intermediate portions of said strap between said front and back shoulder portions and child support portion to partially encircle a child when straddling said lower looped end.

10. An infant carrier according to claim 9, including a second shoulder strap member having opposite ends releasably secured to front and back portions of said endless strap for extension over the other shoulder of the wearer.

11. An infant carrier according to claim 9, said padding portion being composed of a flexible material several times the thickness of said strap.

12. An infant carrier according to claim 9, including a shoulder support pad of elongated generally tubular configuration in closely surrounding relation to the shoulder portion of said strap.

13. An infant carrier according to claim 9, said side support strap having opposite ends releasably secured to intermediate portions of said endless strap, and a padding member of elongated generally tubular configuration in closely surrounding relation to said side support strap.

* * * * *